US005776878A

United States Patent [19]

Thoen

[11] Patent Number: 5,776,878

[45] Date of Patent: Jul. 7, 1998

[54] LIQUID DETERGENT COMPOSITIONS CONTAINING BRIGHTENERS AND POLYMERS FOR PREVENTING FABRIC SPOTTING

[75] Inventor: Christiaan Arthur J. K. Thoen, North Shields, United Kingdom

[73] Assignee: The Procter & Gamble Company, Cincinnati, Ohio

[21] Appl. No.: 669,522

[22] PCT Filed: Jan. 11, 1995

[86] PCT No.: PCT/US95/00396

§ 371 Date: Jul. 10, 1996

§ 102(e) Date: Jul. 10, 1996

[87] PCT Pub. No.: WO95/19419

PCT Pub. Date: Jul. 20, 1995

[30] Foreign Application Priority Data

Jan. 13, 1994 [EP] European Pat. Off. ..... 94300227

[51] Int. Cl.[6] ..... C11D 3/37; C11D 3/42; C11D 3/395; C11D 1/83

[52] U.S. Cl. ..... 510/307; 510/276; 510/302; 510/313; 510/324; 510/340; 510/360; 510/287

[58] Field of Search ..... 510/276, 302, 510/307, 313, 324, 340, 360, 287

[56] References Cited

U.S. PATENT DOCUMENTS

| | | | |
|---|---|---|---|
| H1468 | 8/1995 | Costa et al. | 252/174.12 |
| 3,159,611 | 12/1964 | Dunn et al. | 260/88.3 |
| 4,548,744 | 10/1985 | Connor | 252/545 |
| 5,009,980 | 4/1991 | El-Sayed et al. | 430/114 |
| 5,458,809 | 10/1995 | Fredj et al. | 252/542 |
| 5,458,810 | 10/1995 | Fredj et al. | 252/542 |
| 5,460,752 | 10/1995 | Fredj et al. | 252/542 |
| 5,466,802 | 11/1995 | Panandiker et al. | 544/193.2 |
| 5,470,507 | 11/1995 | Fredj et al. | 252/542 |
| 5,474,576 | 12/1995 | Thoen et al. | 8/111 |
| 5,478,489 | 12/1995 | Fredj et al. | 252/99 |
| 5,478,500 | 12/1995 | Swift et al. | 252/547 |
| 5,710,119 | 1/1998 | Busch et al. | 510/360 |

FOREIGN PATENT DOCUMENTS

| | | | |
|---|---|---|---|
| A-327927A2 | 8/1989 | European Pat. Off. | C11D 3/37 |
| A-2814287 | 10/1979 | Germany | C11D 3/29 |
| 3840056 | 5/1990 | Germany . | |
| A-4027832 | 9/1990 | Germany | C11D 3/37 |
| 1097450 | 1/1968 | United Kingdom . | |
| WO 94/00546 | 1/1994 | WIPO | C11D 3/28 |
| WO 94/02579 | 2/1994 | WIPO | C11D 3/37 |
| WO 94/11480 | 5/1994 | WIPO | C11D 3/28 |

*Primary Examiner*—Paul Lieberman
*Assistant Examiner*—Charles Boyer
*Attorney, Agent, or Firm*—Ken K. Patel; Kim W. Zerby; Jacobus C. Rasser

[57] ABSTRACT

Compositions for reducing brightener spotting comprise a polymer selected from the group consisting of polyamine N-oxide containing polymers, N-vinylimidazole N-vinylpyrrolidone copolymers and mixtures thereof, a stilbene brightener, and from 5% to 7% hydrogen peroxide, wherein the weight ratio of the polymer to the brightener is from 1:20 to 20:1 and the pH of the composition is from 2 to 6.

20 Claims, No Drawings

LIQUID DETERGENT COMPOSITIONS CONTAINING BRIGHTENERS AND POLYMERS FOR PREVENTING FABRIC SPOTTING

TECHNICAL FIELD

The present invention relates to liquid detergent compositions comprising optical brighteners. More in particular, the present invention relates to the use of polyamine N-oxide containing polymers and/or N-vinylimidazole N-vinylpyrrolidone copolymers in detergent compositions containing brighteners for reducing fabric spotting associated with the use of said brighteners.

BACKGROUND OF THE INVENTION

Optical brighteners, also known as fluorescent whitening agents, are commonly used in liquid laundry additives. Brighteners deposit onto fabrics where they absorb ultraviolet radiant energy and reemit it as blue light.

This reduces or eliminates any yellowish cast to fabrics and gives them a bright appearance.

A specific problem associated with liquid detergent compositions containing brighteners is their undiluted application on textiles, on which high brightener concentration becomes visible as a whitener spot.

The present invention is based on the discovery that polyamine N-oxide containing polymers and/or N-vinylimidazole N-vinylpyrrolidone copolymers inhibit the fabric spotting of brighteners. Said polymers are used to complex or absorb the fugitive dyes washed out of dyed fabrics before they have the opportunity to become attached to other articles in the wash.

Copending EP Patent Application 92202168.8 describes dye transfer inhibiting compositions comprising polyamine N-oxides containing polymers. N-vinylimidazole N-vinylpyrrolidone copolymers are described in prior art documents such as DE 2 814 287-A which relates to detergent compositions comprising 0.1 to 10 wt % water-soluble or water-dispersible N-vinyl imidazole homo- or copolymer in combination with anionic and/or nonionic surfactants and other detergent ingredients. EP 372 291 relates to a process for washing discolouration-sensitive textiles. The wash liquor contains anionic/nonionic surfactants and watersoluble polymers e.g. (co)polymers N-vinylimidazole, N-vinyloxazolidone or N-vinylpyrrolidone. EP 327 927 describes a granular detergent additive comprising water-soluble polymeric compounds based on N-vinylpyrrolidone and/or N-vinylimidazole and/or N-vinyloxazolidone and cationic compounds. DE 4027832-A discloses electrolyte-free liquid detergent compositions comprising zeolite A, nonionic surfactants and dye transfer inhibiting polymers. The dye transfer inhibiting polymers are homo-and copolymers selected from N-vinylpyrrolidone and/or N-vinylimidazole and/or N-vinyloxazolidone.

According to the present invention, a liquid detergent composition comprising a brightener is provided which reduces or eliminates the fabric spotting of brighteners upon pretreatment.

SUMMARY OF THE INVENTION

The present invention relates to the use of a polyamine N-oxide containing polymers and/or N-vinylimidazole N-vinylpyrrolidone copolymers in liquid detergent compositions for inhibiting fabric spotting associated with detergent compositions containing brighteners.

DETAILED DESCRIPTION OF THE INVENTION

The compositions of the present invention comprise as essential elements a brightener and a polymer selected from polyamine N-oxide containing polymers and/or N-vinylimidazole N-vinylpyrrolidone copolymers.

(a) Polyamine N-oxide containing polymers

The compositions of the present invention comprise as an essential element a polymer selected from polyamine N-oxide containing polymers which contain units having the following structure formula:

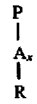

(I)

wherein

P is a polymerisable unit, whereto the N—O group can be attached to or wherein the N—O group forms part of the polymerisable unit or a combination of both.

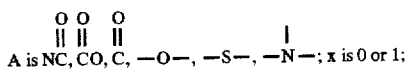

A is NC, CO, C, —O—, —S—, —N—; x is 0 or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures

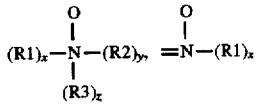

wherein

R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both.

Suitable polyamine N-oxides wherein the N—O group forms part of the polymerisable unit comprise polyamine N-oxide containing polymers wherein R is selected from aliphatic, aromatic, alicyclic or heterocyclic groups.

One class of said polyamine N-oxide containing polymers comprises the group of polyamine N-oxides wherein the nitrogen of the N—O group forms part of the R-group. Preferred polyamine N-oxide containing polymers are those wherein R is a heterocyclic group such as pyridine, pyrrole, imidazole, pyrrolidine, piperidine, quinoline, acridine and derivatives thereof.

Another class of said polyamine N-oxide containing polymers comprises the group of polyamine N-oxides wherein the nitrogen of the N—O group is attached to the R-group.

Other suitable polyamine N-oxides are the polyamine oxides whereto the N—O group is attached to the polymerisable unit.

Preferred class of these polyamine N-oxides are the polyamine N-oxides having the general formula (I) wherein R is an aromatic, heterocyclic or alicyclic groups wherein the nitrogen of the N—O functional group is part of said R group. Examples of these classes are polyamine oxides wherein R is a heterocyclic compound such as pyridine, pyrrole, imidazole and derivatives thereof.

Another preferred class of polyamine N-oxides are the polyamine N-oxide containing polymers having the general formula (I) wherein R are aromatic, heterocyclic or alicyclic groups wherein the nitrogen of the N—O functional group is attached to said R groups. Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide containing polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine N-oxide containing polymers can be obtained in almost any degree of polymerisation. The degree of polymerisation is not critical provided the material has the desired water-solubility and dye-suspending power.

Typically, the average molecular weight is within the range of 500 to 1000,000; preferably from 1,000 to 50,000, more preferably from 2,000 to 30,000, most preferably from 3,000 to 20,000.

The polyamine N-oxide containing polymers of the present invention are typically present from 0.001 to 10%, more preferably from 0.01 to 2%, most preferred from 0.05 to 1% by weight of the dye transfer inhibiting composition.

The present compositions are conveniently used as additives to conventional detergent compositions for use in laundry operations. The present invention also encompasses dye transfer inhibiting compositions which will contain detergent ingredients and thus serve as detergent compositions.

Methods for making polyamine N-oxides

The production of the polyamine-N-oxides may be accomplished by polymerizing the amine monomer and oxidizing the resultant polymer with a suitable oxidizing agent, or the amine oxide monomer may itself be polymerized to obtain the polyamine N-oxide. The synthesis of polyamine N-oxide can be exemplified by the synthesis of polyvinylpyrridine N-oxide.

Poly-4-vinylpyridine ex Polysciences (mw. 50 000, 5.0 g., 0.0475 mole) was predisolved in 50 ml acetic acid and treated with a peracetic acid solution (25 g of glacial acetic acid, 6.4 g of a 30% vol. solution of $H_2O_2$, and a few drops of $H_2SO_4$ give 0.0523 mols of peracetic acid) via a pipette. The mixture was stirred over 30 minutes at ambient temperature (32 C.). The mixture was then heated to 80–85 C. using an oil bath for 3 hours before allowing to stand overnight. The polymer solution then obtained is mixed with 11 of acetone under agitation. The resulting yellow brown viscous syrup formed on the bottom is washed again with 11 of aceton to yield a pale crystalline solid.

The solid was filtered off by gravity, washed with acetone and then dried over $P_2O_5$.

The amine: amine N-oxide ratio of this polymer is 1:4.

The N-vinylimidazole N-vinylpyrrolidone copolymer

The present invention comprises as an essential detergent ingredient a polymer selected from the N-vinylimidazole N-vinylpyrrolidone copolymers.

The N-vinylimidazole N-vinylpyrrolidone polymers have an average molecular weight range from 5000–1,000,000, preferably from 20 000–200,000.

Highly preferred polymers for use in detergent compositions according to the present invention comprise a polymer selected from N-vinylimidazole N-vinylpyrrolidone copolymers wherein said polymer has an average molecular weight range from 5,000 to 50,000 more preferably from 8,000 to 30,000, most preferably from 10,000 to 20,000.

The average molecular weight range was determined by light scattering as described in Barth H. G. and Mays J. W. Chemical Analysis Vol.113. "Modern Methods of Polymer Characterization.

Preferred N-vinylimidazole N-vinylpyrrolidone copolymers have an average molecular weight range from 5,000 to 50,000, more preferably from 8,000 to 30,000, most preferably from 10,000 to 20,000.

The N-vinylimidazole N-vinylpyrrolidone copolymers characterized by having said average molecular weight range provide excellent dye transfer inhibiting properties while not adversely affecting the cleaning performance of detergent compositions formulated therewith.

The N-vinylimidazole N-vinylpyrrolidone copolymer of the present invention has a molar ratio of N-vinylimidazole to N-vinylpyrrolidone from 1:1 to 0.2:1, more preferably from 0.8:1 to 0.3:1, most preferably from 0.6:1 to 0.4:1.

The N-vinylimidazole N-vinylpyrrolidone copolymers can be lineair or branched. The level of the N-vinylimidazole N-vinylpyrrolidone present in the detergent compositions is from 0.01 to 10%, more preferably from 0.05 to 5%, most preferably from 0.1 to 1% by weight of the detergent composition.

(b) Brightener

An essential ingredient of the compositions according to the present invention is a brightener. Suitable brighteners include stilbene brighteners. Stilbene brighteners are aromatic compounds with two aryl groups separated by an alkene chain. They preferably have the following structural formula:

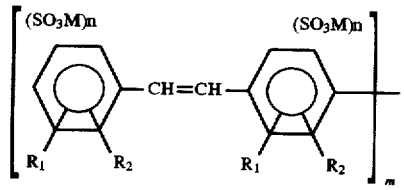

wherein $R_1$ is hydrogen, halogen, alkyl, alkoxy or phenyl; $R_2$ is hydrogen or alkyl;

M is hydrogen, an alkali metal or ammonium ion;

n=0–2, but the formula must contain at least one $SO_3M$ group; and m=1–2 and when m=1, the substituent on the linkage carbon is hydrogen.

Especially suitable stilbene brighteners for use herein are described in U.S. Pat. Nos. 4,309,316, 4,298,490 and 5,035,825.

Bleach-stable anionic brighteners with sulfonic acid group(s) which work on cotton (cellulosics) are preferred.

The most preferred stilbene brighteners for use herein, because it is bleach-stable, is Tinopal$^R$ CBS-X, which is benzenesulfonic acid, 2,2'-((1,1'-biphenyl)-4,4'-diyldi-2,1-ethenediyl)bis-, disodium salt (CA Index Name). The formula for Tinopal$^R$ CBS-X is

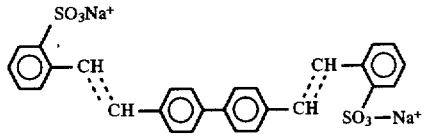

Other brighteners that can be used are hydrophobic having the formula:

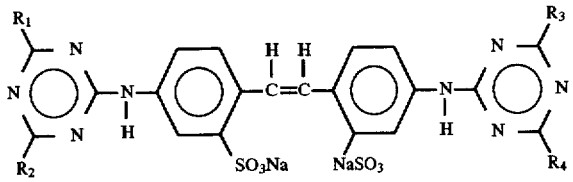

wherein $R_1$, $R_2$, $R_3$ and $R_4$ represent, selected independently, anilino, cyclohexylamino, piperazino, phenylenediamino, toluenediamino, morpholino, and aminophenol, with the proviso that the brightener contains not more than one morpholino group.

Suitable brightener species include any combination of the possible $R_{1-4}$ moieties. Examples of preferred brightener species are the tetra-anilino, tetra-piperazino, tetra-cyclohexylamino and combinations thereof such as for example the di-anilinodipiperazino; and the dianilino-dicyclohexylamino species.

Highly preferred for reasons of minimizing brightener staining are the tetraanilio derivatives, having the following formula:

4,4'-bis (4-anilino-6-anilino-s-triazin-2-yl)amino)-2,2'-stilbene disulfonic acid sodium salt (A). A preferred brightener system in the context of this invention contains at least 40% (by reference to the total amount of the detergent brightener) of the specific hydrophobic brightener referred to hereinbefore in combination with a conventional detergent brightener, e.g., a di-sulfonated dianilino, dimorpholino stilbene brightener.

Conventional detergent brighteners for use in combination with the hydrophobic species described hereinabove embrace common detergent brighteners inclusives of:

4,4(2H-naphtho(1,2-d)triazol-2-yl)-2-stilbenesulfonic acid, sodium salt; (i)

4,4'-Bis((4-anilino-6(N-2-hydroxyethyl-N-methylamino)-s-triazin-2yl) amino)-2,2'stilbenedisulfonic acid disodium salt; (ii)

4,4'-bis((4-anilino-6-morpholino-s-trizain-2-yl)amino)-2,2'-stilbene-disulfonic acid, sodium salt; (iii)

2,2-(4,4'-biphenylene divinylene)-dibenzenesulfonic acid, disodium salt; (ivi)

4,4'-bis(4-phenyl-2H-1,2,3-triazol-2-yl)disodium salt (vi)

4,4'-bis(4-anilino-6-morpholino-1,3,5-triazin-2-yl)amino)-2-stilbene sulfonate sodium salt.

The weight ratio of polyamine N-oxide containing polymer and/or N-vinylimidazole N-vinylpyrrolidone to the brightener present in the detergent composition is from 1/20 to 20/1, preferably from 1/10 to 12/1, more preferably from 2/1 to 7/1.

Detergent ingredients

In another embodiment of the present invention, a liquid detergent composition is provided comprising the dye transfer inhibiting composition mixed with detergent ingredients. A wide range of surfactants can be used in the detergent composition of the present invention.

A typical listing of anionic, nonionic, ampholytic and zwitterionic classes, and species of these surfactants, is given in U.S. Pat. No. 3,664,961 issued to Norris on May 23, 1972.

Preferred anionic surfactants include the alkyl sulfate surfactants hereof which are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12}$–$C_{16}$ are preferred for lower wash temperatures (e.g. below about 50° C.) and $C_{16-C18}$ alkyl chains are preferred for higher wash temperatures (e.g. above about 50° C.).

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl, trimethyl-ammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}E(1.0)M$), $C_{12}$–$C_{18}$ alkyl polyethoxylate (2.25) sulfate ($C_{12}$–$C_{18}E(2.25)M$), $C_{12}$–$C_{18}$ alkyl polyethoxylate (3.0) sulfate ($C_{12}$–$C_{18}E(3.0)M$), and $C_{12}$–$C_{18}$ alkyl polyethoxylate (4.0) sulfate ($C_{12}$–$C_{18}E(4.0)M$), wherein M is conveniently selected from sodium and potassium.

Other suitable anionic surfactants to be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

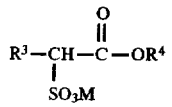

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other anionic surfactants useful for detersive purposes can also be included in the laundry detergent compositions of the present invention. These can include salts (including, for example, sodium, potassium, ammonium, and substituted ammonium salts such as mono-, di-and triethanolamine salts) of soap, $C_9$–$C_{20}$ linear alkylbenzenesulfonates, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$—$CH_2COO$—M+ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the laundry detergent compositions of the present invention typically comprise from about 0.2% to about 40%, preferably from about 0.5% to about 20% by weight of such anionic surfactants.

One class of nonionic surfactants useful in the present invention are condensates of ethylene oxide with a hydrophobic moiety to provide a surfactant having an average hydrophilic-lipophilic balance (HLB) in the range from 6 to 17, preferably from 8 to 17, more preferably from 9.5 to 14, most preferably from 12 to 14. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Preferred nonionic surfactants include C9–C13 primary alcohol ethoxylates containing 3–30 moles of ethylene oxide per mole of alcohol.

Other nonionics that can be used are C13–C15 primary alcohol alkoxylates containing polyethoxy blocks comprising 1 to 2 ethoxy groups and also containing polypropoxy blocks comprising 3 to 4 propoxy groups.

Especially preferred nonionic surfactants are the $C_9$–$C_{15}$ primary alcohol ethoxylates containing 3–12 moles of ethylene oxide per mole of alcohol, particularly the $C_{12}$–$C_{15}$ primary alcohols containing 5–8 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula

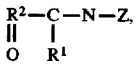

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

When included therein, the laundry detergent compositions of the present invention typically comprise from about 0.5% to about 40%, preferably from about 0.5% to about 20% by weight of such nonionic surfactans, highly preferred from 0.5% to 10%.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable builders can be an inorganic ion exchange material, commonly an inorganic hydrated aluminosilicate material, more particularly a hydrated synthetic zeolite such as hydrated zeolite A, X, B or HS. Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates builders for use herein include citric acid, preferably in the form of a water-soluble salt, derivatives of succinic acid of the formula R—CH(COOH) CH2(COOH) wherein R is C10–20 alkyl or alkenyl, preferably C12–16, or wherein R can be substituted with hydroxyl, sulfo sulfoxyl or sulfone substituents. Specific examples include lauryl succinate, myristyl succinate, palmityl succinate2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071. Especially for the liquid execution herein, suitable fatty acid builders for use herein are saturated or unsaturated C10–18 fatty acids, as well as the corresponding soaps. Preferred saturated species have from 12 to 16 carbon atoms in the alkyl chain. The preferred unsaturated fatty acid is oleic acid. Another preferred builder system for liquid compositions is based on dodecenyl succinic acid.

Other suitable water-soluble organic salts are the homo- or co-polymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 2% to 80% by weight of the composition preferably from 20% to 70% and most usually from 30% to 60% by weight.

Detergent compositions according to the present invention may include bleaching agents. The bleaching agent suitable for the present invention can be an activated or non-activated bleaching agent.

One category of oxygen bleaching agent that can be used encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, U.S. patent application Ser. No. 740,446, European Patent Application 0,133,354 and U.S. Pat. No. 4,412,934. Highly preferred bleaching agents also include 6-nonylamino-6-oxoperoxycaproic acid as described in U.S. Pat. No. 4,634,551.

Another category of bleaching agents that can be used encompasses the halogen bleaching agents. Examples of hypohalite bleaching agents, for example, include trichloro isocyanuric acid and the sodium and potassium dichloroisocyanurates and N-chloro and N-bromo alkane sulphonamides. Such materials are normally added at 0.5–10% by weight of the finished product, preferably 1–5% by weight.

Preferably, the bleaches suitable for the present invention include peroxygen bleaches. Examples of suitable water-soluble solid peroxygen bleaches include hydrogen peroxide releasing agents such as perborates, e.g. perborate monohydrate, perborate tetrahydrate, persulfates, percarbonates, peroxydisulfates, perphosphates and peroxyhydrates. Preferred bleaches are percarbonates and perborates.

The hydrogen peroxide releasing agents can be used in combination with bleach activators such as tetraacetylethylenediamine (TAED), nonanoyloxybenzenesulfonate (NOBS, described in U.S. Pat. No. 4,412,934), 3,5,-trimethylhexanoloxybenzenesulfonate (ISONOBS, described in EP 120,591) or pentaacetylglucose (PAG), which are perhydrolyzed to form a peracid as the active bleaching species, leading to improved bleaching effect. Also suitable activators are acylated citrate esters (ATC) such as disclosed in Copending European Patent Application No. 91870207.7.

A preferred bleaching agent is hydrogen peroxide.

The hydrogen peroxide may be present as such or may be present by adding an enzymatic system (i.e. an enzyme and a substrate therefore) which is capable of generating hydrogen peroxide at the beginning or during the washing and/or rinsing process. Such enzymatic systems are disclosed in EP Patent Application 91202655.6 filed Oct. 9, 1991.

Other peroxygen bleaches suitable for the present invention include organic peroxyacids such as percarboxylic acids.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. These materials can be deposited upon the substrate during the washing process. Upon irradiation with light, in the presence of oxygen, such as by hanging clothes out to dry in the daylight, the sulfonated zinc phthalocyanine is activated and, consequently, the substrate is bleached. Preferred zinc phthalocyanine and a photoactivated bleaching process are described in U.S. Pat. No. 4,033,718. Typically, detergent compositions will contain about 0.0001% to about 1.25%, by weight, of sulfonated zinc phthalocyanine. In addition, it has been found that the polyamine-N-oxide containing polymers eliminate or reduce the deposition of said photoactivated bleaching agents onto fabrics resulting in substantial no fabric spotting upon pretreatment and/or in the wash.

Other detergent ingredients that can be included are detersive enzymes which can be included in the detergent formulations for a wide variety of purposes including removal of protein-based, carbohydrate-based, or triglyceride-based stains, for example, and prevention of refugee dye transfer. The enzymes to be incorporated include proteases, amylases, lipases, cellulases, and peroxidases, as well as mixtures thereof Other types of enzymes may also be included. They may be of any suitable origin, such as vegetable, animal, bacterial, fungal and yeast origin.

Enzymes are normally incorporated at levels sufficient to provide up to about 5 mg by weight, more typically about 0.05 mg to about 3 mg, of active enzyme per gram of the composition.

Suitable examples of proteases are the subtilisins which are obtained from particular strains of *B. subtilis* and *B. licheniforms*. Proteolytic enzymes suitable for removing protein-based stains that are commercially available include those sold under the tradenames Alcalase, Savinase and Esperase by Novo Industries A/S (Denmark) and Maxatase by International Bio-Synthetics, Inc. (The Netherlands) and FN-base by Genencor, Optimase and opticlean by MKC.

Of interest in the category of proteolytic enzymes, especially for liquid detergent compositions, are enzymes referred to herein as Protease A and Protease B. Protease A is described in European Patent Application 130,756. Protease B is described in European Patent Application Serial No. 87303761.8. Amylases include, for example, -amylases obtained from a special strain of *B. licheniforms*, described in more detail in British Patent Specification No. 1,296,839 (Novo). Amylolytic proteins include, for example, Rapidase, Maxamyl (International Bio-Synthetics, Inc.) and Termamyl,(Novo Industries).

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, which discloses fungal cellulase produced from *Humicola insolens*. Suitable cellulases are also disclosed in GB-A-2,075,028; GB-A-2,095,275 and DE-OS-2,247,832.

Examples of such cellulases are cellulases produced by a strain of *Humicola insolens* (*Humicola grisea* var. thermoidea), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (Dolabella Auricula Solander).

Other suitable cellulases are cellulases originated from Humicola Insulins having a molecular weight of about 50 KDa, an isoelectric point of 5.5 and containing 415 amino acids. Such cellulase are described in Copending European patent application No. 93200811.3, filed Mar. 19, 1993.

Especially suitable cellulase are the cellulase having color care benefits. Examples of such cellulases are cellulase described in European patent application No. 91202879.2, filed Nov. 6, 1991 Carezyme (Novo).

Suitable lipase enzymes for detergent usage include those produced by microorganisms of the Pseudomonas group, such as *Pseudomonas stutzeri* ATCC 19.154, as disclosed in British Patent 1,372,034. Suitable lipases include those which show a positive immunoligical cross-reaction with the antibody of the lipase, produced by the microorganism *Pseudomonas fluorescent* IAM 1057. This lipase is available from Amano Pharmaceutical Co. Ltd., Nagoya, Japan, under the trade name Lipase P "Amano," hereinafter referred to as "Amano-P".

Especially suitable Lipase are lipase such as M1 Lipase (Ibis) and Lipolase (Novo).

Peroxidase enzymes are used in combination with oxygen sources, e.g. percarbonate, perborate, persulfate, hydrogen peroxide, etc. They are used for "solution bleaching", i.e. to prevent transfer of dyes of pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT Internation Application WO 89/099813 and in European Patent application EP No. 91202882.6, filed on Nov. 6, 1991.

In liquid formulations, an enzyme stabilization system is preferably utilized. Enzyme stabilization techniques for aqueous detergent compositions are well known in the art. For example, one technique for enzyme stabilization in aqueous solutions involves the use of free calcium ions from sources such as calcium acetate, calcium formate and calcium propionate. Calcium ions can be used in combination with short chain carboxylic acid salts, preferably formates. See, for example, U.S. Pat. No. 4,318,818. It has also been proposed to use polyols like glycerol and sorbitol. Alkoxyalcohols, dialkylglycoethers, mixtures of polyvalent alcohols with polyfunctional aliphatic amines (e.g., such as diethanolamine, triethanolamine, di-isopropanolamime, etc.), and boric acid or alkali metal borate. Enzyme stabilization techniques are additionally disclosed and exemplified in U.S. Pat. No. 4,261,868, U.S. Pat. No. 3,600,319, and European Patent Application Publication No. 0 199 405, Application No. 86200586.5. Non-boric acid and borate stabilizers are preferred. Enzyme stabilization systems are also described, for example, in U.S. Pat. Nos. 4,261,868, 3,600,319 and 3,519,570.

Other suitable detergent ingredients that can be added are enzyme oxidation scavengers which are described in Copending European Patent aplication N 92870018.6 filed on Jan. 31, 1992. Examples of such enzyme oxidation scavengers are ethoxylated tetraethylene polyamines.

Other components used in detergent compositions may be employed, such as soil-suspending agents soil-release agents, abrasives, bactericides, tarnish inhibitors, coloring agents, and perfumes. In addition, it has been found that the polyamine-N-oxide containing polymers eliminate or reduce the deposition of coloring agents onto fabrics resulting in substantial no fabric spotting upon pretreatment and/or in the wash.

The liquid compositions according to the present invention can also be in "concentrated form", in such case, the liquid detergent compositions according to the present invention will contain a lower amount of water, compared to conventional liquid detergents Typically, the water content of the concentrated liquid detergent is less than 30%, more preferably less than 20%, most preferably less than 10% by weight of the detergent compositions.

The present invention has found to be extremely useful when the liquid detergents are in direct contact with the fabrics such as during pretreatment. However, the present invention is also very suitable for inhibiting fabric spotting encountered during fabric laundering operations.

The process of the invention can be carried out before or in the course of the washing process. The washing process is preferably carried out at 5° C. to 95° C., especially 20° C. to 60° C., The pH of the treatment solution is from 2 to 10.5, preferably from 3:5 to 10.5, more preferably from 2 to 6.

The process and compositions of the invention can also be used as laundry detergent additive products.

Typically, the laundry additive compositions contain no more than 10% by weight of a surfactant. The compositions according to the present invention have proven to be very useful when formulated in said laundry additive compositions.

Such additive products are intended to supplement or boost the performance of conventional detergent compositions.

The detergent compositions according to the present invention include compositions which are to be used for cleaning substrates, such as fabrics, fibers, hard surfaces, skin etc., for example hard surface cleaning compositions (with or without abrasives), laundry detergent compositions, automatic and non automatic dishwashing compositions.

The following examples are meant to exemplify compositions of the present inventions, but are not necessarily meant to limit the scope of the invention.

A liquid detergent composition according to the present invention is prepared having the following composition:

TABLE I

| % by weight of the total detergent composition | |
|---|---|
| | (a) |
| Poly ethoxy propoxy alcohol | 1.00 |
| Alkyl sulphate | 1.00 |
| BHT (Butyl hydroxy toluene) | 0.03 |
| Perfume (Miraflor) | 0.10 |
| Hydrogen peroxide | 7.00 |
| $H_2SO_4$ | to pH 4 |
| Distilled water | |

The extent of reduction on brightener spotting was studied under different conditions corresponding to possible product usage conditions on 100% cotton fabrics. These product usage conditions were as follows:

I) Product applied on fabric for 10 minutes and then washed in laundero-meter. (T: 40° C./washing time:25 min.)

II) Product dried on fabric and then washed in laundero-meter. (T: 40° C./washing time: 25 min.)

III) Product applied on fabric for 10 minutes and then rinsed

IV) Product dried on fabric and then rinsed

The fabric spotting was assessed by visual inspection of the samples under sunlight by a panel of expert graders, using the following scale.

| | |
|---|---|
| psu 0 | I am sure there is no brightener spotting |
| psu 1 | I seem to see a light spot but I am not sure |
| psu 2 | I am sure there is a light spot |
| psu 3 | I am sure there is a spot |
| psu 4 | There is a heavy spot |

EXPERIMENTAL CONDITIONS

A: A detergent composition according to Table 1 which contains no brightener and no poly(4-vinylpyridine-N-oxide)

B: A detergent composition according to Table 1 which contains 0.06% by weight of brightener (Tynopal CBS-X) and no poly(4-vinylpyridine-N-oxide)

C: A detergent composition according to Table 1 which contains poly(4-vinylpyridine-N-oxide which has an average molecular weight of about 10 000 and an amine to amine N-oxide ratio of 1:5 (determined by NMR) and no brightener.

D: A detergent composition according to Table 1 which contains brightener (Tynopal CBS-X and 0.06% by weight of poly(4-vinylpyridine-N-oxide) which has an average molecular weight of about 10 000 and an amine to amine N-oxide ratio of 1:5 (determined by NMR)

The results were as follows:

| | A | B | C | D |
|---|---|---|---|---|
| I | 0 | 2 | 0 | 0 |
| II | 0 | 3 | 0 | 1 |
| III | 0 | 2 | 0 | 0 |
| IV | 0 | 4 | 0 | 2 |

As can be seen from the above results, brightener spotting is significantly reduced by the addition of poly(4-vinylpyridine)-N-oxide.

The following laundry liquid detergent compositions were made:

| | I | II | III | IV |
|---|---|---|---|---|
| $C_{12}$–$C_{15}$ Alkyl sulfate | — | 19.0 | 21.0 | — |
| $C_{12}$–$C_{15}$ Alkyl ethoxylated sulfate | 23.0 | 4.0 | 4.0 | 25.0 |
| $C_{12}$–$C_{14}$ N-methyl glucamide | 9.0 | 9.0 | 9.0 | 9.0 |
| $C_{12}$–$C_{14}$ fatty alcohol ethoxylate | 6.0 | 6.0 | 6.0 | 6.0 |
| $C_{12}$–$C_{16}$ Fatty acid | 9.0 | 6.8 | 14.0 | 14.0 |
| Brightener | 0.1 | 0.1 | 0.1 | 0.1 |
| N-vinylimidazole N-vinyl-pyrrolidone copolymer | 0.5 | 0.5 | — | — |
| Poly(4-vinylpyridine)-N-oxide | — | — | 0.5 | 0.5 |
| Hydrogen peroxide | 5 | 5 | 5 | 5 |
| Citric acid anhydrous | 6.0 | 4.5 | 3.5 | 3.5 |

-continued

| | I | II | III | IV |
|---|---|---|---|---|
| Diethylene triamine penta methylene phosphonic acid | 1.0 | 1.0 | 2.0 | 2.0 |
| Water & Minors | - - - up to 100% - - - | | | |

The above compositions (I–IV) were very good at displaying detergent performance with excellent color-care benefits without creating significant fabric spotting on the fabrics.

The following liquid laundry additives were made:

| | (a) | (b) | (c) | (d) |
|---|---|---|---|---|
| Dobanol ® 91-10 | — | — | 3 | 3 |
| Dobanol ® 23-3 | — | — | 1 | 1 |
| Dobanol ® 23-6.5 | — | — | 1 | 1 |
| Lutensol ® A030 | — | — | 1 | 1 |
| Poly ethoxy propoxy alcohol | 1 | 1 | — | — |
| Alkyl sulphate | 1 | 1 | — | — |
| BHT (Butyl hydroxy toluene) | 1 | 1 | — | — |
| Perfume (Miraflor) | 1 | 1 | 1 | 1 |
| Isofol 16 | — | — | 0.2 | 0.2 |
| N-vinylimidazole N-vinyl-pyrrolidone copolymer | 0.3 | — | 0.3 | — |
| Poly(4-vinylpyrridine)-N-oxide | — | 0.3 | — | 0.3 |
| Brightener | 0.06 | 0.06 | 0.06 | 0.06 |
| Hydrogen peroxide | 7 | 7 | 7 | 7 |
| $H_2SO_4$ | to pH 4 | | | |

The above compositions (a)–(d) were very good at displaying detergent performance with excellent color-care benefits without creating significant fabric spotting on the fabrics.

I claim:

1. A method of reducing brightener spotting comprising the step of washing fabric with a composition comprising a polymer selected from the group consisting of polyamine N-oxide containing polymers, N-vinylimidazole N-vinylpyrrolidonedone copolymers and mixtures thereof, a stilbene brightener, and from 5% to 7% hydrogen peroxide, wherein the weight ratio of the polymer to the brightener is from 1:20 to 20:1 and the pH of the composition is from 2 to 6.

2. A method according to claim 1, wherein the weight ration of the polymer to the brightener is from 1:10 to 12:1.

3. A method according to claim 2, wherein the weight ratio of the polymer to the brightener is from 1:1 to 12:1.

4. A method according to claim 3, wherein the weight ratio of the polymer to the brightener is from 2:1 to 7:1.

5. A method according to claim 1, wherein the composition comprises from 0.001% to 10%, by weight, of a polyamine N-oxide containing polymer.

6. A method according to claim 1, wherein the composition comprises from 0.01% to 10%, by weight, of a N-vinylimidazole N-vinylpyrrolidone copolymer.

7. A liquid composition comprising a polymer selected from the group consisting of polyamine N-oxide containing polymers, N-vinylimidazole N-vinylpyrrolidone copolymers and mixtures thereof, a stilbene brightener, and from 5% to 7% hydrogen peroxide, wherein the weight ratio of the polymer to the brightener is from 1:20 to 20:1 and the pH of the composition is from 2 to 6.

8. A liquid composition according to claim 7, wherein the weight ratio of the polymer to the brightener is from 1:10 to 12:1.

9. A liquid composition according to claim 8, wherein the weight ratio of the polymer to the brightener is from 1:1 to 12:1.

10. A liquid composition according to claim 9, wherein the weight ratio of the polymer to the brightener is from 2:1 to 7:1.

11. A liquid composition according to claim 7, wherein the composition comprises from 0.001% to 10%, by weight, of a polyamine N-oxide containing polymer.

12. A liquid composition according to claim 11, wherein the polyamine N-oxide containing polymer has a molar ratio of amine to amine N-oxide of 2:3 to 1:1,000,000.

13. A liquid composition according to claim 11, wherein the polyamine N-oxide containing polymer has a molecular weight of from 500 to 1,000,000.

14. A liquid composition according to claim 11, wherein the composition comprises from 0.01% to 10%, by weight, of a N-vinylimidazole N-vinylpyrrolidone copolymer.

15. A liquid composition according to claim 14, wherein the N-vinylimidazole N-vinylpyrrolidone copolymer has a molecular weight of from 5000 to 1,000,000.

16. A liquid composition according to claim 7, wherein the brightener is benzenesulfonic acid, 2,2'-((1,1'-biphenyl)-4,4'-diyldi-2,1-etheneidyl)Bis-, disodium salt.

17. A liquid composition according to claim 7, comprising 0.06% to 0.1%, by weight, brightener.

18. A liquid composition according to claim 7, comprising no more than 10%, by weight, surfactant.

19. A liquid composition according to claim 7, comprising, by weight, from about 0.2% to about 40% anionic surfactant and from about 0.05% to about 40% nonionic surfactant.

20. A liquid composition according to claim 7, comprising, by weight, from 0.1% to 1% polymer, 0.06% to 1% brightener, and 5% to 7% hydrogen peroxide, and having a weight ratio of the polymer to the brightener of from 2:1 to 7:1.

* * * * *